US008393615B1

(12) United States Patent
Hsu

(10) Patent No.: US 8,393,615 B1
(45) Date of Patent: Mar. 12, 2013

(54) DOCUMENT POSITION-LIMITING MECHANISM

(75) Inventor: Wei-Hsun Hsu, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 0 days.

(21) Appl. No.: 13/331,024

(22) Filed: Dec. 20, 2011

(30) Foreign Application Priority Data

Sep. 2, 2011 (TW) ..... 100131666 A

(51) Int. Cl.
*B65H 1/00* (2006.01)

(52) U.S. Cl. ..... 271/171

(58) Field of Classification Search ..... 271/171, 271/240, 223
See application file for complete search history.

(56) References Cited

U.S. PATENT DOCUMENTS 5,611,528 A * 3/1997 Nakamura et al. ..... 271/164
2010/0001460 A1* 1/2010 Kawarago ..... 271/162
2010/0270735 A1* 10/2010 Allwright et al. ..... 271/171

* cited by examiner

*Primary Examiner* — Patrick Cicchino
(74) *Attorney, Agent, or Firm* — Kirton McConkie; Evan R. Witt

(57) ABSTRACT

A document position-limiting mechanism includes a first paper guide plate, a second paper guide plate, a connecting wheel and a switching module. The first paper guide plate and the second paper guide plate are used for guiding a document on a paper input tray to be fed into an automatic document feeder. Through the connecting wheel, the first paper guide plate and the second paper guide plate are movable on the paper input tray. By means of the switching module, two operating modes of the document position-limiting mechanism can selected by the user in order to meet the requirements of different users.

10 Claims, 8 Drawing Sheets

DOCUMENT POSITION-LIMITING MECHANISM

FIELD OF THE INVENTION

The present invention relates to a document position-limiting mechanism, and more particularly to a document position-limiting mechanism for use in a paper input tray of an automatic document feeder.

BACKGROUND OF THE INVENTION

Generally, an automatic document feeder and an image scanner are collectively defined as an automatic scanning apparatus to automatically scanning a plurality of paper sheets. Alternatively, an automatic document feeder and a printer are collectively defined as an automatic printing apparatus. The automatic document feeder can be used for feeding various types of documents with different sizes. For example, the automatic document feeder is widely employed to feed the A4-sized documents. As known, if the document is not confined at the middle region of the paper input tray, the document is readily aslant fed into the internal portion of the automatic document feeder. Under this circumstance, the scanning operation or the printing operation is usually incomplete. For solving this drawback, the paper input tray of the automatic document feeder is usually equipped with a document position-limiting mechanism for confining the document at the middle region of the paper input tray.

FIG. 1 is a schematic perspective view illustrating a document position-limiting mechanism installed on a paper input tray of an automatic document feeder according to the prior art. The document position-limiting mechanism 2 is applied to a paper input tray 1 of an automatic document feeder. The paper input tray 1 has a plurality of graduations 10, 11 and 12. These graduations 10, 11 and 12 are located at a first side of the document position-limiting mechanism 2. In addition, the graduations 10, 11 and 12 are shown on an outer surface 13 of the paper input tray 1, and arranged in a line. A first graduation 10 of these graduations corresponds to an A6-sized document. A second graduation 11 of these graduations corresponds to an A5-sized document. A third graduation 12 of these graduations corresponds to an A4-sized document.

The document position-limiting mechanism 2 comprises a first paper guide plate 20, a second paper guide plate 21 and a connecting wheel 22. The first paper guide plate 20 is disposed on the paper input tray 1. In addition, the first paper guide plate 20 comprises a first paper stopper 201 and a first rack 202. The first paper stopper 201 is exposed to the outer surface 13 of the paper input tray 1 for stopping a first edge of a document (not shown). The first rack 202 is disposed on an inner surface 14 of the paper input tray 1 and in contact with the connecting wheel 22.

Similarly, the second paper guide plate 21 is disposed on the paper input tray 1 and located at a side of the first paper guide plate 20. In addition, the second paper guide plate 21 comprises a second paper stopper 211 and a second rack 212. The second paper stopper 211 is exposed to the outer surface 13 of the paper input tray 1 for stopping a second edge of the document. The second rack 212 is disposed on the inner surface 14 of the paper input tray 1 and in contact with the connecting wheel 22. The connecting wheel 22 is arranged between the first paper guide plate 20 and the second paper guide plate 21, and contacted with and engaged with the first rack 202 of the first paper guide plate 20 and the second rack 212 of the second paper guide plate 21, respectively. Consequently, the first paper guide plate 20 and the second paper guide plate 21 are moved in opposite directions. That is, as the first paper guide plate 20 is moved in a first direction D1, the second paper guide plate 21 is moved in a second direction D2 opposite to the first direction D1 through the connecting wheel 22, and vice versa.

When the user wants to scan an A4-sized document, the document position-limiting mechanism 2 should be firstly adjusted to comply with the A4-sized document. The method of adjusting the document position-limiting mechanism 2 comprises the following steps. First of all, the first paper guide plate 20 is moved to the location corresponding to the third graduation 12 while the first paper guide plate 20 is aligned with the third graduation 12 by naked eyes. In response to movement of the first paper guide plate 20, the second paper guide plate 21 is moved to a corresponding location. Then, the A4-sized document is placed on the document position-limiting mechanism 2. Meanwhile, the first edge of the document is stopped by the first paper stopper 201 of the first paper guide plate 20, and the second edge of the document is stopped by the second paper stopper 211 of the second paper guide plate 21. In such way, the document will not be aslant fed into the internal portion of the automatic document feeder.

From the above discussions, the document position-limiting mechanism 2 has a plurality of graduations 10, 11 and 12. Before the document to be fed is placed on the paper input tray 1, the relative locations of the first paper guide plate 20 and the second paper guide plate 21 are adjusted according to the size of the document and the graduations 10, 11 and 12. Since the ways of recognizing the location of the graduation and aligning the first paper guide plate 20 with the graduation are very inconvenient for many users, another document position-limiting mechanism without the need of using the naked eyes to align the graduation has been disclosed.

FIG. 2 is a schematic perspective view illustrating another document position-limiting mechanism installed on a paper input tray of an automatic document feeder according to the prior art. FIG. 3 is a schematic bottom view illustrating the document position-limiting mechanism of FIG. 2. Please refer to FIGS. 2 and 3. The document position-limiting mechanism 4 is installed on a paper input tray 3 of an automatic document feeder. The paper input tray 3 has a plurality of graduations 30, 31 and 32. These graduations 30, 31 and 32 are located at a first side of the document position-limiting mechanism 4. In addition, the graduations 30, 31 and 32 are shown on an outer surface 33 of the paper input tray 3, and arranged in a line. A first graduation 30 of these graduations corresponds to an A6-sized document. A second graduation 31 of these graduations corresponds to an A5-sized document. A third graduation 32 of these graduations corresponds to an A4-sized document. As shown in FIG. 3, the paper input tray 3 further comprises a plurality of recesses 35, 36 and 37. These recesses 35, 36 and 37 are located at an inner surface 34 of the paper input tray 3. The first recess 35 of these recesses is aligned the first graduation 30. The second recess 36 of these recesses is aligned with the second graduation 31. The third recess 37 of these recesses is aligned with the third graduation 32.

The document position-limiting mechanism 4 comprises a first paper guide plate 40, a second paper guide plate 41 and a connecting wheel 42. The first paper guide plate 40 is disposed on the paper input tray 3. In addition, the first paper guide plate 40 comprises a first paper stopper 401 and a first rack 402. The first paper stopper 401 is exposed to the outer surface 33 of the paper input tray 3 for stopping a first edge of a document (not shown). The first rack 402 is disposed on the inner surface 34 of the paper input tray 3 and in contact with the connecting wheel 42.

Similarly, the second paper guide plate 41 is disposed on the paper input tray 3 and located at a side of the first paper guide plate 40. In addition, the second paper guide plate 41 comprises a second paper stopper 411, a second rack 412 and a protrusion 413. The second paper stopper 411 is exposed to the outer surface 33 of the paper input tray 3 for stopping a second edge of the document. The second rack 412 is disposed on the inner surface 34 of the paper input tray 3 and in contact with the connecting wheel 42. The protrusion 413 is located adjacent to the recesses 35, 36 and 37 of the paper input tray 3. As the second paper guide plate 41 is moved, the protrusion 413 is selectively inserted into one of these recesses 35, 36 and 37. The connecting wheel 42 is arranged between the first paper guide plate 40 and the second paper guide plate 41, and contacted with and engaged with the first rack 402 of the first paper guide plate 40 and the second rack 412 of the second paper guide plate 41, respectively. Consequently, the first paper guide plate 40 and the second paper guide plate 41 are moved in opposite directions.

When the user wants to scan an A4-sized document, the document position-limiting mechanism 4 should be firstly adjusted to comply with the A4-sized document. The method of adjusting the document position-limiting mechanism 4 comprises the following steps. First of all, the location of the third graduation 32 corresponding to the A4-sized document is realized by the naked eyes. Then, the second paper guide plate 41 is moved toward the location of the third graduation 32. As the second paper guide plate 41 is moved, the protrusion 413 of the second paper guide plate 41 is inserted into the third recess 37 corresponding to the third graduation 32. Whereas, in response to movement of the second paper guide plate 41, the first paper guide plate 40 is moved to a corresponding location. Then, the A4-sized document is placed on the document position-limiting mechanism 4. Meanwhile, the first edge of the document is stopped by the first paper stopper 401 of the first paper guide plate 40, and the second edge of the document is stopped by the second paper stopper 411 of the second paper guide plate 41. In such way, the document will not be aslant fed into the internal portion of the automatic document feeder.

In the conventional document position-limiting mechanism 4, the location of the second paper guide plate 41 can be fixed when the protrusion 413 of the second paper guide plate 41 is inserted into one of the recesses 35, 36 and 37. That is, the use of the document position-limiting mechanism 4 does not need to precisely align the graduations corresponding to various document sizes with the naked eyes. However, in comparison with the conventional document position-limiting mechanism 2 that can be applied to the documents of various sizes (including the unofficial document sizes), the conventional document position-limiting mechanism 4 is only used to confine the document of a special size (e.g. A4, A5 and A6). Therefore, there is need of providing a document position-limiting mechanism that is applicable to the documents of various sizes and can be easily operated without using the naked eyes to align the graduation.

SUMMARY OF THE INVENTION

The present invention provides a document position-limiting mechanism whose operating mode is switchable according to the users' requirements.

In accordance with an aspect of the present invention, there is provided a document position-limiting mechanism for use in a paper input tray of an automatic document feeder. The document position-limiting mechanism includes a first paper guide plate, a second paper guide plate, a connecting wheel, and a switching module. The first paper guide plate is disposed on the paper input tray for guiding a document to be fed into the automatic document feeder. In addition, the first paper guide plate has an extension arm. The second paper guide plate is located at a side of the first paper guide plate for guiding the document to be fed into the automatic document feeder. The second paper guide plate is movable in a direction opposite to a moving direction of the first paper guide plate. The connecting wheel is arranged between the first paper guide plate and the second paper guide plate, and respectively engaged with the first paper guide plate and the second paper guide plate, so that the second paper guide plate is movable in the direction opposite to the moving direction of the first paper guide plate. The switching module is disposed on the paper input tray for switching an operating mode of the document position-limiting mechanism from a manual positioning mode to a graduation positioning mode or from the graduation positioning mode to the manual positioning mode. The witching module includes a driving part and a positioning part. The driving part includes a switching button, which is exposed to the paper input tray. The switching module is moved by operating the switching button. The positioning part is includes a plurality of recesses and a pivotal structure. The pivotal structure is located at a second end of the positioning part and connected to the paper input tray. As the switching button is moved, the positioning part is swung in response to movement of the driving part. When the extension arm is inserted into one of the plurality of recesses, the document position-limiting mechanism is operated in the graduation positioning mode. Wherein, when the extension arm is disengaged from the plurality of recesses, the document position-limiting mechanism is operated in the manual positioning mode.

In an embodiment, the switching module further includes a linking part, which is arranged between the driving part and the positioning part for connecting the driving part and the positioning part. Moreover, the driving part, the positioning part and the linking part are integrally formed.

In an embodiment, the positioning part further includes a supporting structure, which is located at a first end of the positioning part. The driving part further includes a post, which is located at a first end of the driving part. When the post is embedded into the supporting structure, the first end of the positioning part is in contact with the first end of the driving part.

In an embodiment, when the switching button is moved in a first direction, the driving part is correspondingly moved and the post is sustained against the supporting structure, so that the positioning part is swung in a first rotating direction with the pivotal structure serving as a fulcrum and the extension arm is inserted into one of the plurality of recesses. When the switching button is moved in a second direction opposite to the first direction, the driving part is correspondingly moved and the post is separated from the supporting structure, so that the positioning part is swung in a second rotating direction with the pivotal structure serving as the fulcrum and the extension arm is disengaged from the plurality of recesses.

In an embodiment, the pivotal structure is connected to the paper input tray by a screwing means, so that the pivotal structure is rotatable relative to the paper input tray. Moreover, the pivotal structure is integrally formed with the positioning part.

In an embodiment, the extension arm further includes a protrusion, which is located at an end of the extension arm. When the document position-limiting mechanism is operated in the graduation positioning mode, the protrusion is inserted into one of the recesses.

In an embodiment, the first paper guide plate further includes a first paper stopper and a first rack, and the second paper guide plate further comprises a second paper stopper and a second rack. The first paper stopper is exposed to an outer surface of the paper input tray for stopping a first edge of the document. The first rack is connected with the first paper stopper and engaged with the connecting wheel. The second paper stopper is exposed to the outer surface of the paper input tray for stopping a second edge of the document. The second rack is connected with the second paper stopper and engaged with the connecting wheel.

In an embodiment, the connecting wheel further includes a wheel body and a plurality of toothed structures. The wheel body is disposed on the inner surface of the paper input tray. The toothed structures are disposed on the wheel body and engaged with the first rack and the second rack, so that the wheel body is rotatable relative to the first rack and the second rack.

In an embodiment, the driving part further includes a fixing bulge, and the paper input tray further includes a first positioning notch and a second positioning notch. The fixing bulge is disposed on an inner surface of the paper input tray. The first positioning notch is located at a first side of the inner surface of the paper input tray. The second positioning notch is located at the first side of the inner surface of the paper input tray and adjacent to the first positioning notch. When the document position-limiting mechanism is operated in the manual positioning mode, the fixing bulge is inserted into the first positioning notch. Whereas, when the document position-limiting mechanism is operated in the graduation positioning mode, the fixing bulge is inserted into the second positioning notch.

In an embodiment, the fixing bulge and the switching button are integrally formed with the driving part.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
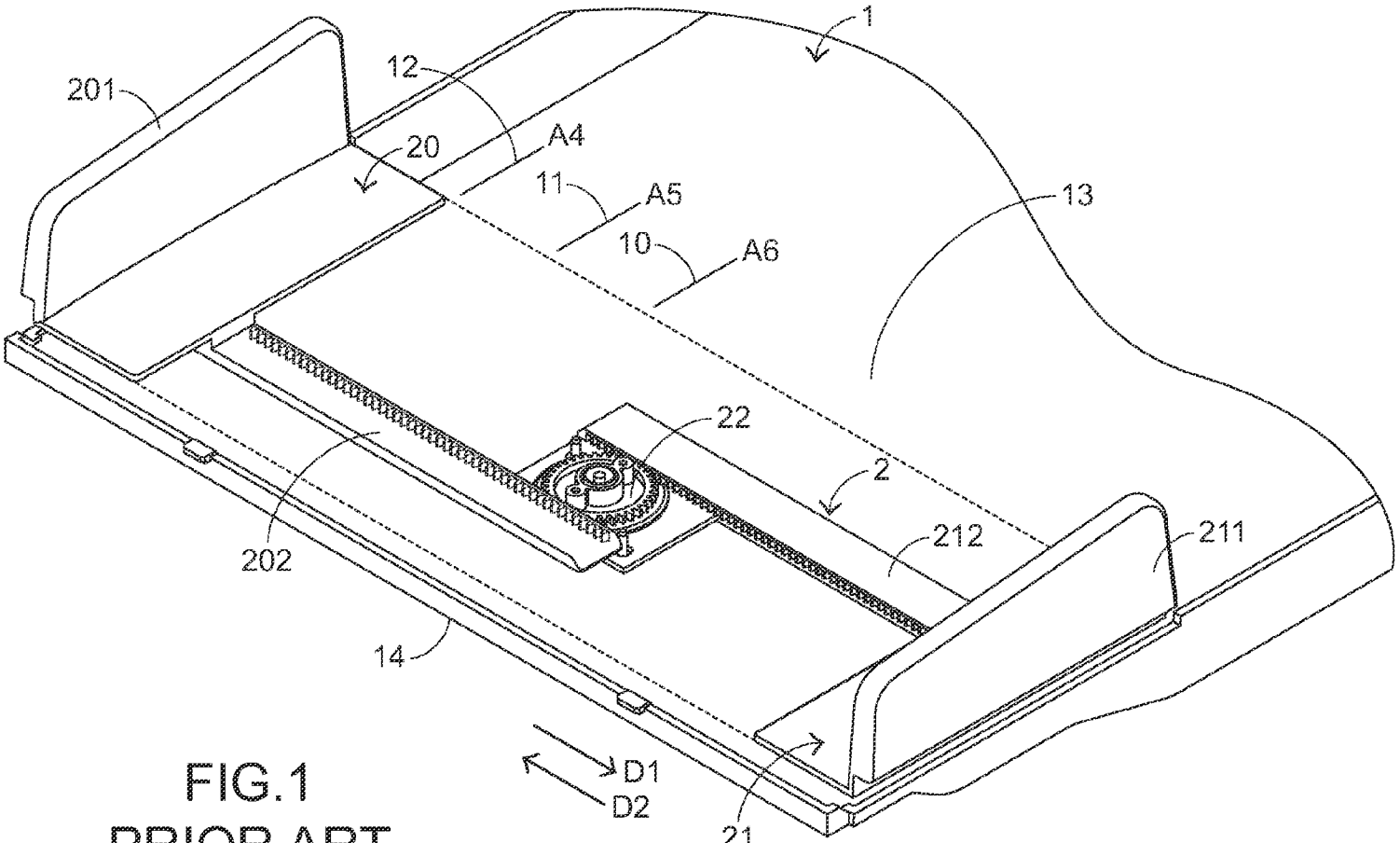
FIG.1 PRIOR ART
FIG. 1 is a schematic perspective view illustrating a document position-limiting mechanism installed on a paper input tray of an automatic document feeder according to the prior art.
Figure 2:
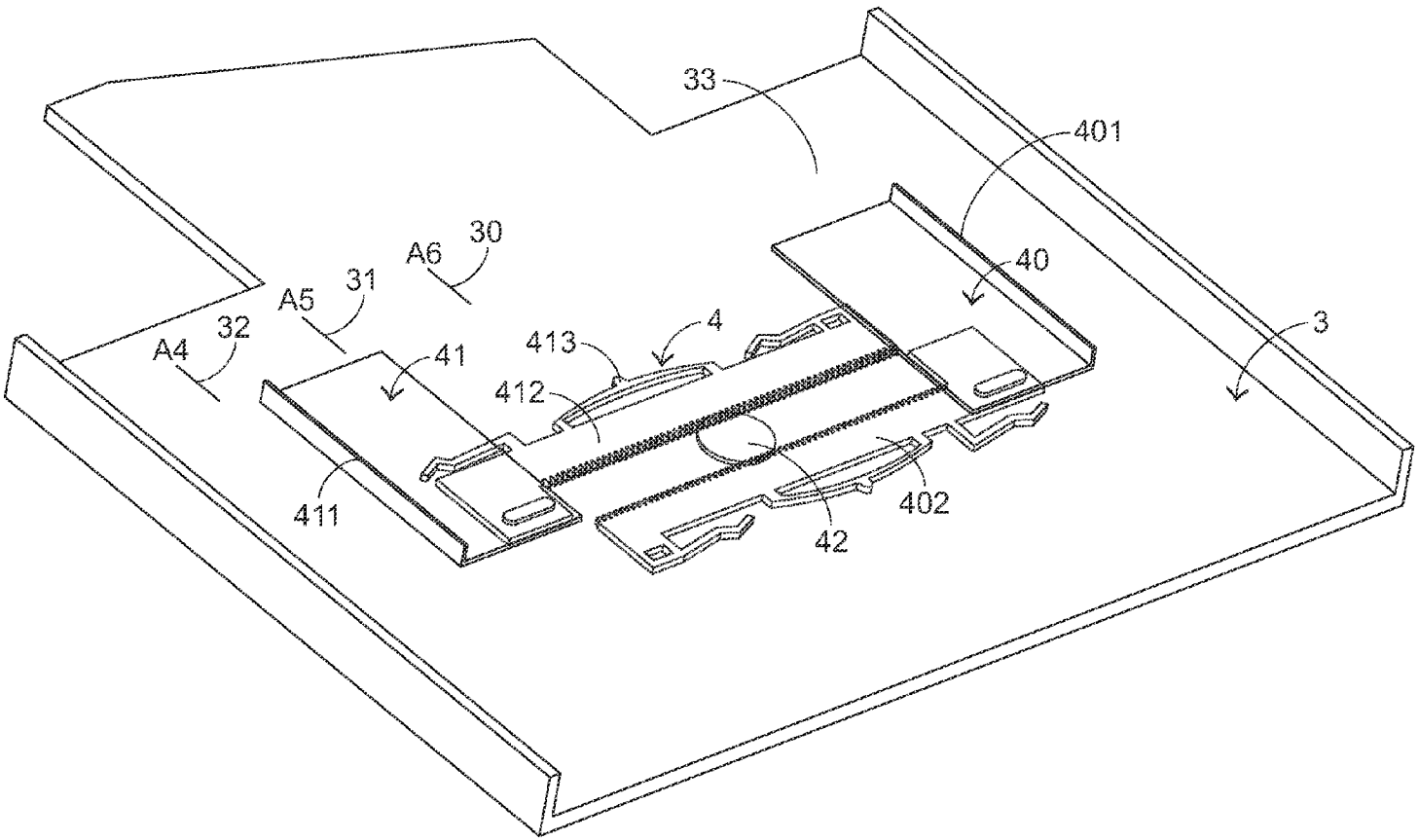
FIG.2 PRIOR ART
FIG. 2 is a schematic perspective view illustrating another document position-limiting mechanism installed on a paper input tray of an automatic document feeder according to the prior art.
Figure 3:
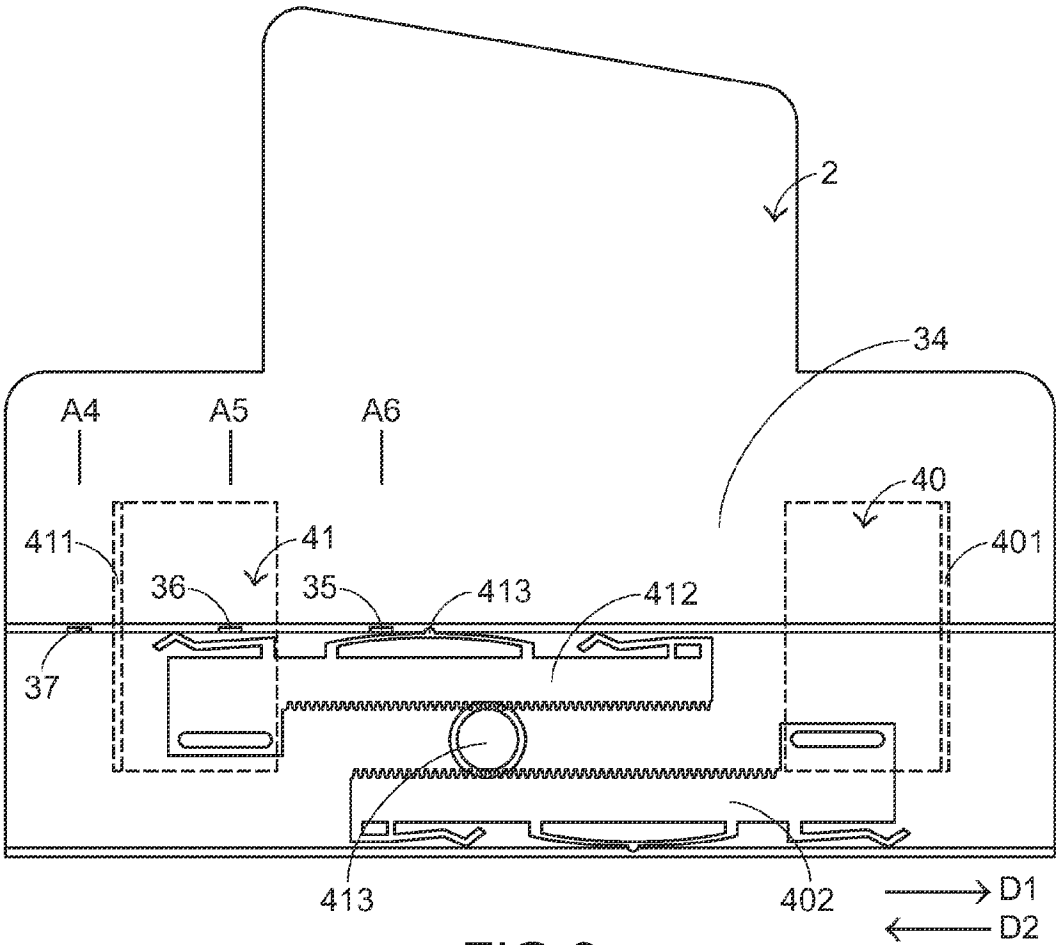
FIG. 3 PRIOR ART
FIG. 3 is a schematic bottom view illustrating the document position-limiting mechanism of FIG. 2.
Figure 4:
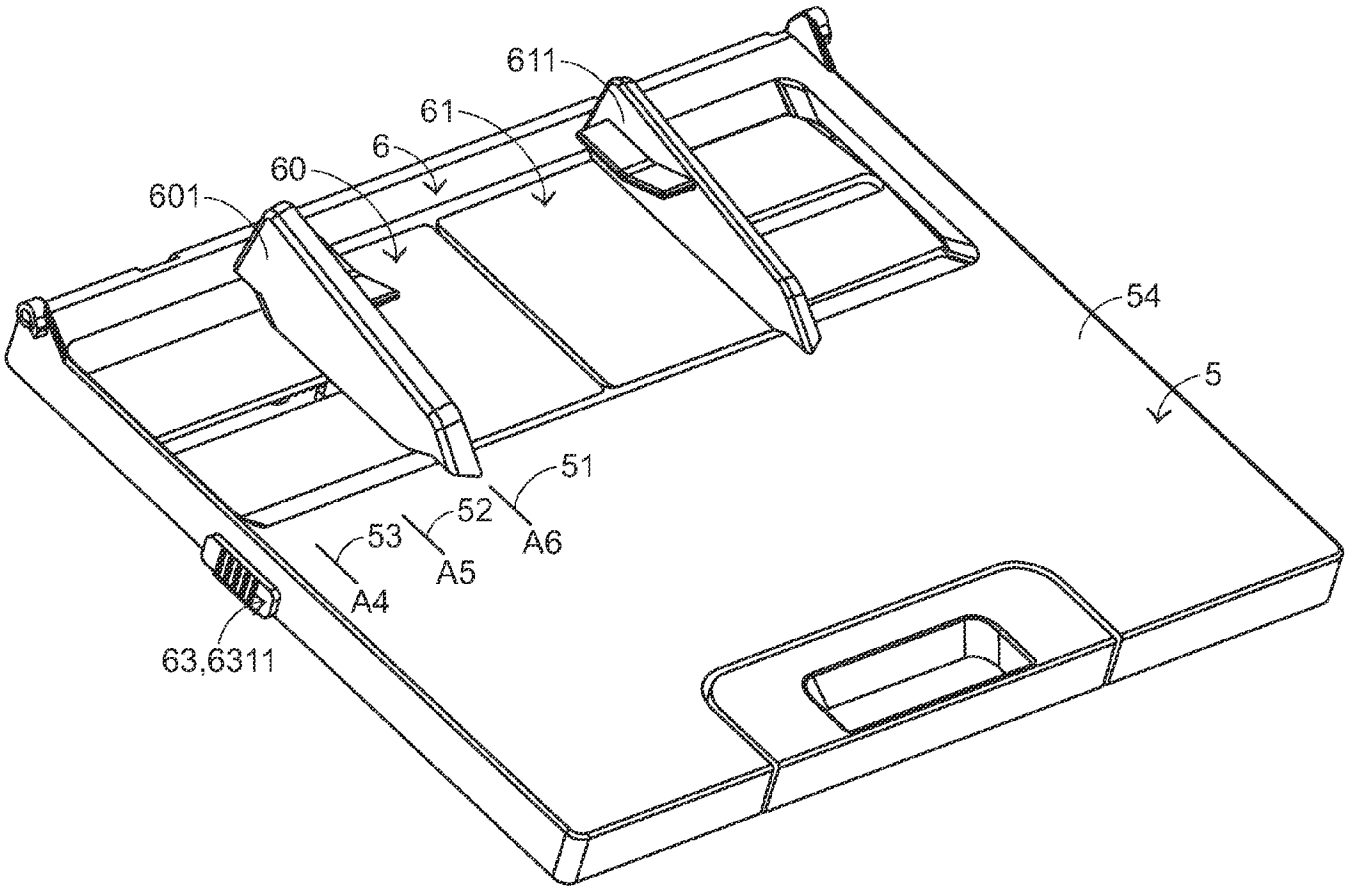
FIG. 4 is a schematic perspective view illustrating a document position-limiting mechanism installed on a paper input tray of an automatic document feeder according to an embodiment of the present invention.
Figure 5:
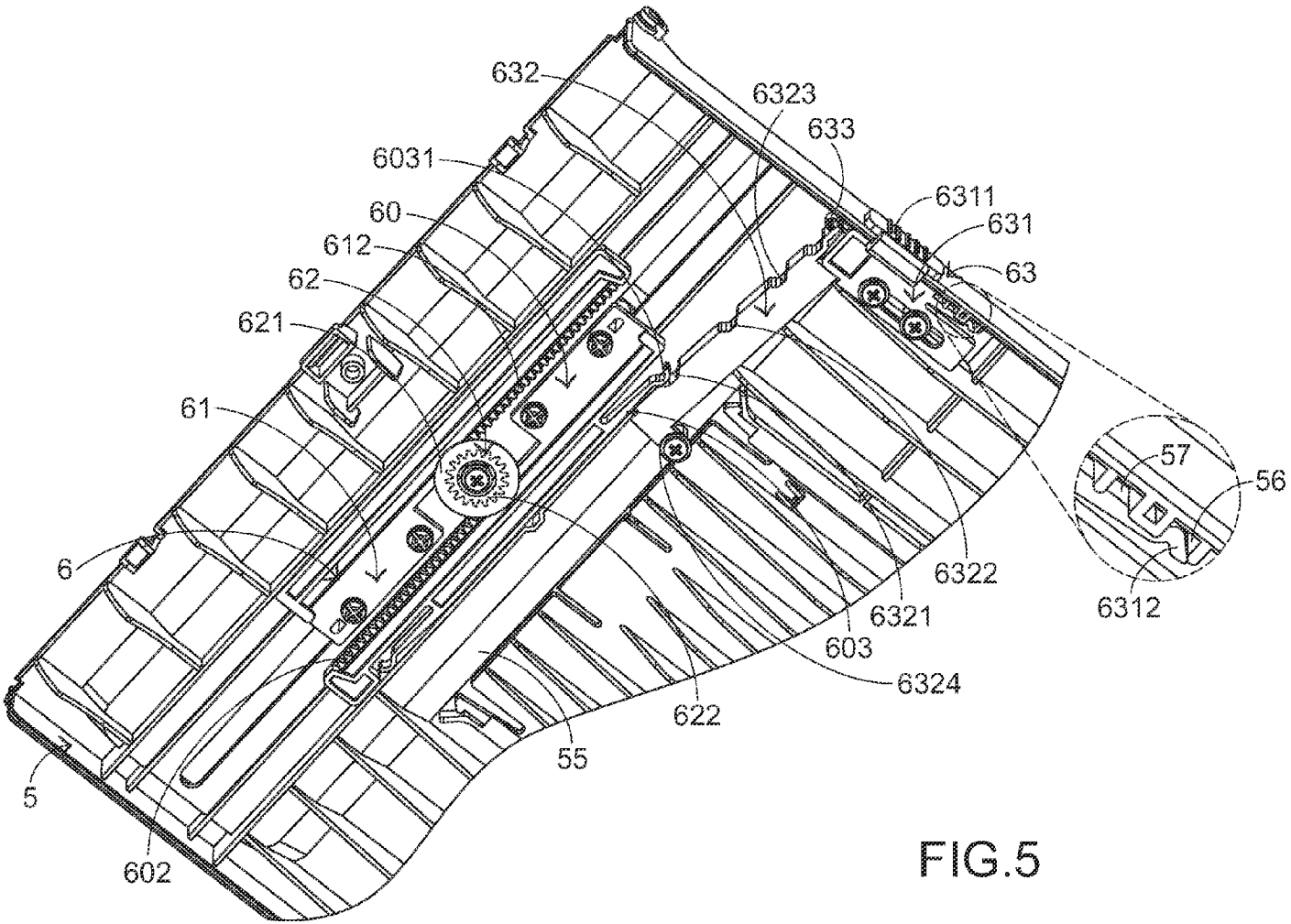
FIG. 5 is a schematic perspective view illustrating the document position-limiting mechanism of FIG. 4 and taken along another viewpoint.

For obviating the drawbacks encountered from the prior art, the present invention provides a document position-limiting mechanism. FIG. 4 is a schematic perspective view illustrating a document position-limiting mechanism installed on a paper input tray of an automatic document feeder according to an embodiment of the present invention. FIG. 5 is a schematic perspective view illustrating the document position-limiting mechanism of FIG. 4 and taken along another viewpoint. Please refer to FIGS. 4 and 5. The document position-limiting mechanism 6 is applied to a paper input tray 5 of an automatic document feeder (not shown). The paper input tray 5 has a plurality of graduations 51, 52 and 53. These graduations 51, 52 and 53 are located at a first side of the document position-limiting mechanism 6. In addition, the graduations 51, 52 and 53 are shown on an outer surface 54 of the paper input tray 5, and arranged in a line. A first graduation 51 of these graduations corresponds to an A6-sized document. A second graduation 52 of these graduations corresponds to an A5-sized document. A third graduation 53 of these graduations corresponds to an A4-sized document.

As shown in FIG. 5, the paper input tray 5 further comprises a first positioning notch 56 and a second positioning notch 57. The first positioning notch 56 is located at a first side of an inner surface 55 of the paper input tray 5. The second positioning notch 57 is located at the first side of the inner surface 55 of the paper input tray 5, and arranged adjacent to the first positioning notch 56. The document position-limiting mechanism 6 comprises a first paper guide plate 60, a second paper guide plate 61, a connecting wheel 62 and a switching module 63. The first paper guide plate 60 is disposed on the paper input tray 5 for guiding a document (not shown) to be fed into the internal portion of the automatic document feeder. In addition, the first paper guide plate 60 comprises a first paper stopper 601, a first rack 602 and an extension arm 603. The first paper stopper 601 is exposed to the outer surface 54 of the paper input tray 5 for stopping a first edge of the document (not shown). The first rack 602 is disposed on the inner surface 55 of the paper input tray 5 and engaged with the connecting wheel 62. The extension arm 603 is extended from the first rack 602. In addition, the extension arm 603 has a protrusion 6031. The protrusion 6031 is located at an end of the extension arm 603. In this embodiment, the extension arm 603 and the protrusion 6031 are integrally formed with the first rack 602.

Similarly, the second paper guide plate 61 is disposed on the paper input tray 5 and located at a side of the first paper guide plate 60. In addition, the second paper guide plate 61 comprises a second paper stopper 611 and a second rack 612. The second paper stopper 611 is exposed to the outer surface 54 of the paper input tray 5 for stopping a second edge of the document. The second rack 612 is disposed on the inner surface 55 of the paper input tray 5 and engaged with the connecting wheel 62. As shown in FIG. 5, the connecting wheel 62 is arranged between the first paper guide plate 60 and the second paper guide plate 61. The connecting wheel 62 comprises a wheel body 621 and a plurality of toothed structures 622. The wheel body 621 is disposed on the inner surface 55 of the paper input tray 5. These toothed structures 622 are disposed on the wheel body 621 and engaged with the first rack 602 and the second rack 612, so that the wheel body 621 is rotatable relative to the first rack 602 and the second rack 612. Due to the relationship between the first rack 602, the second rack 612 and the connecting wheel 62, as the first paper guide plate 60 is moved in a third direction D3*(see FIG. 7), the second paper guide plate 61 is moved in a fourth direction D4*(see FIG. 7) opposite to the third direction D3*.

Figure 6A:
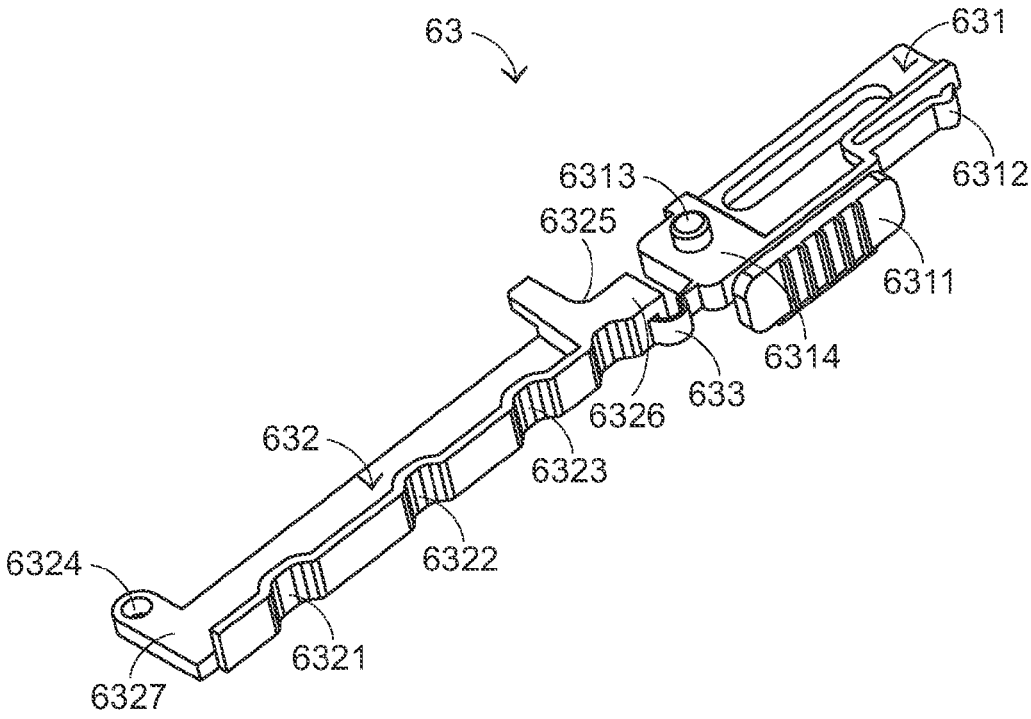
FIGS. 6A and 6B schematically illustrate a switching module used in the document position-limiting mechanism according to an embodiment of the present invention.
Figure 6B:
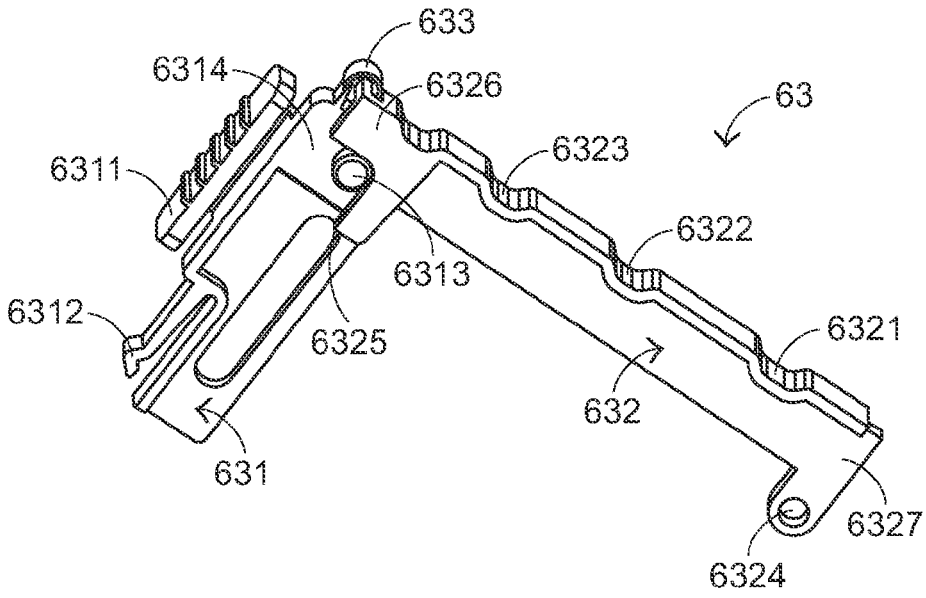

Please refer to FIGS. 6A and 6B, which schematically illustrate a switching module used in the document position-limiting mechanism according to an embodiment of the present invention. As shown in FIG. 6A, the switching module 63 comprises a driving part 631, a positioning part 632 and a linking part 633. The driving part 631 has a switching button 6311, a fixing bulge 6312 and a post 6313. The positioning part 632 comprises a plurality of recesses 6321, 6322, 6323, a pivotal structure 6324, and a supporting structure 6325. The linking part 633 is arranged between the driving part 631 and a positioning part 632 for connecting the driving part 631 and the positioning part 632. In this embodiment, the driving part 631, the positioning part 632 and the linking part 633 are produced by an injection molding technique. Moreover, the driving part 631, the positioning part 632 and the linking part 633 are integrally formed.

As shown in FIG. 6B, the post 6313 is located at a first end 6314 of the driving part 631, and the supporting structure 6325 is located at a first end 6326 of the positioning part 632. Since the linking part 633 is bendable, the post 6313 may be embedded into the supporting structure 6325 and sustained against the supporting structure 6325. Consequently, the first end 6326 of the positioning part 632 is in contact with the first end 6314 of the driving part 631. In this embodiment, the linking part 633 is made of a thermoplastic material. Consequently, the linking part 633 can be repeatedly bent without causing breakage.

Please refer to FIG. 5 again. The switching module 63 is disposed on the paper input tray 5. By means of the switching module 63, the document position-limiting mechanism 6 may be switched from a manual positioning mode to a graduation positioning mode, or switched from the graduation positioning mode to the manual positioning mode. By moving the switching button 6311 of the driving part 631, the switching module 63 is correspondingly moved. In addition, the switching button 6311 is exposed outside the paper input tray 5 (see also FIG. 4). The fixing bulge 6312 is disposed on the inner surface 55 of the paper input tray 5. In this embodiment, the fixing bulge 6312 and the switching button 6311 are integrally formed with the driving part 631. The positioning part 632 is disposed on the inner surface 55 of the paper input tray 5. In addition, the pivotal structure 6324 of the positioning part 632 is located at a second end 6327 of the positioning part 632, and connected to the inner surface 55 of the paper input tray 5. In this embodiment, the pivotal structure 6324 is connected to the inner surface 55 of the paper input tray 5 by a screwing means, so that the pivotal structure 6324 is rotatable relative to the paper input tray 5. The pivotal structure 6324 is integrally formed with the positioning part 632.

Figure 7:
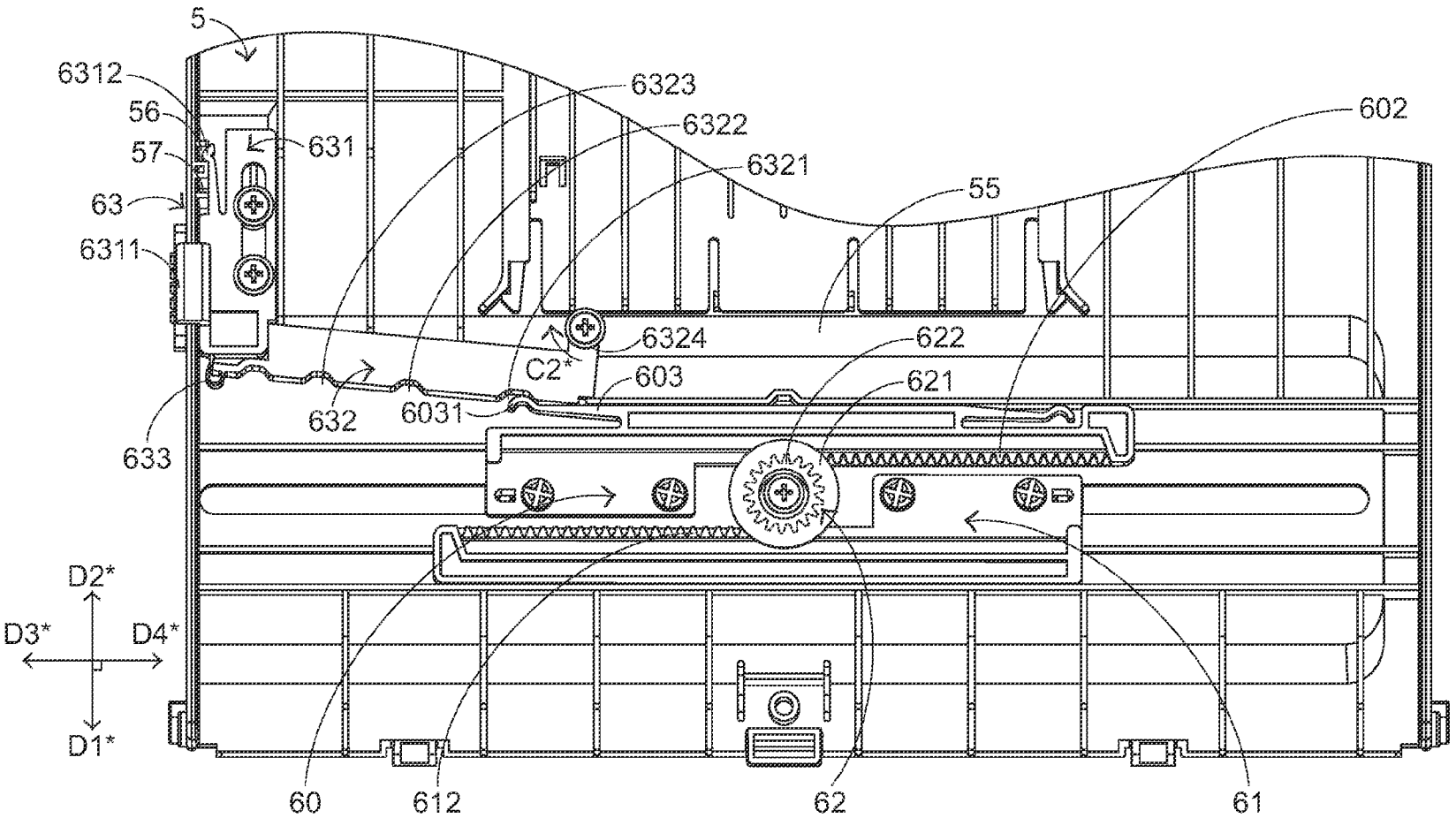
FIG. 7 is a schematic bottom view illustrating the document position-limiting mechanism according to the embodiment of the present invention, in which the document position-limiting mechanism is operated in a manual positioning mode.

FIG. 7 is a schematic bottom view illustrating the document position-limiting mechanism according to the embodiment of the present invention, in which the document position-limiting mechanism is operated in a manual positioning mode. By moving the switching button 6311 in a second direction D2*, the positioning part 632 is rotated in a second rotating direction C2* in response to the movement of the driving part 631. Moreover, the second direction D2* of moving the switching button 6311 is perpendicular to a third direction D3* of moving the first paper guide plate 60 and a fourth direction D4* of moving the second paper guide plate 61.

As the first paper guide plate 60 or the positioning part 632 is moved, the protrusion 6031 of the extension arm 603 may be inserted into one of the recesses 6321, 6322 and 6323. Under this circumstance, the document position-limiting mechanism 6 is operated in the graduation positioning mode. As the protrusion 6031 of the extension arm 603 is disengaged from the corresponding one of the recesses 6321, 6322 and 6323, the document position-limiting mechanism 6 is operated in the manual positioning mode.

The operations of the document position-limiting mechanism 6 in the manual positioning mode and the graduation positioning mode will be illustrated in more details as follows. Please refer to FIGS. 5 and 7. By moving the switching button 6311 in the second direction D2*, the fixing bulge 6312 of the driving part 631 is inserted into the second positioning notch 57. Since the positioning part 632 is connected with the driving part 631 through the linking part 633, in response to the movement of the driving part 631 in the second direction D2*, the positioning part 632 is swung in the second rotating direction C2* by using the pivotal structure 6324 as a fulcrum. As the positioning part 632 is swung, the recesses 6321, 6322 and 6323 of the positioning part 632 is departed from the first paper guide plate 60. Under this circumstance, the document position-limiting mechanism 6 is operated in the manual positioning mode.

When the user wants to scan an A6-sized document, the document position-limiting mechanism 6 should be firstly adjusted to comply with the A6-sized document. The method of adjusting the document position-limiting mechanism 6 comprises the following steps. First of all, the location of the first graduation 51 corresponding to the A6-sized document is realized by the naked eyes. Then, the first paper guide plate 60 is moved toward the location of the first graduation 51 while the first paper guide plate 60 is aligned with the third graduation 51 by naked eyes. Whereas, in response to movement of the first paper guide plate 60, the second paper guide plate 61 is moved to a corresponding location. Then, the A6-sized document is placed on the document position-limiting mechanism 6. Meanwhile, the first edge of the document is stopped by the first paper stopper 601 of the first paper guide plate 60, and the second edge of the document is stopped by the second paper stopper 611 of the second paper guide plate 61. In such way, the possibility of aslant feeding the document into the internal portion of the automatic document feeder will be minimized. That is, the operations of the document position-limiting mechanism 6 in the manual positioning mode are similar to those of the conventional document position-limiting mechanism 2.

Figure 8:
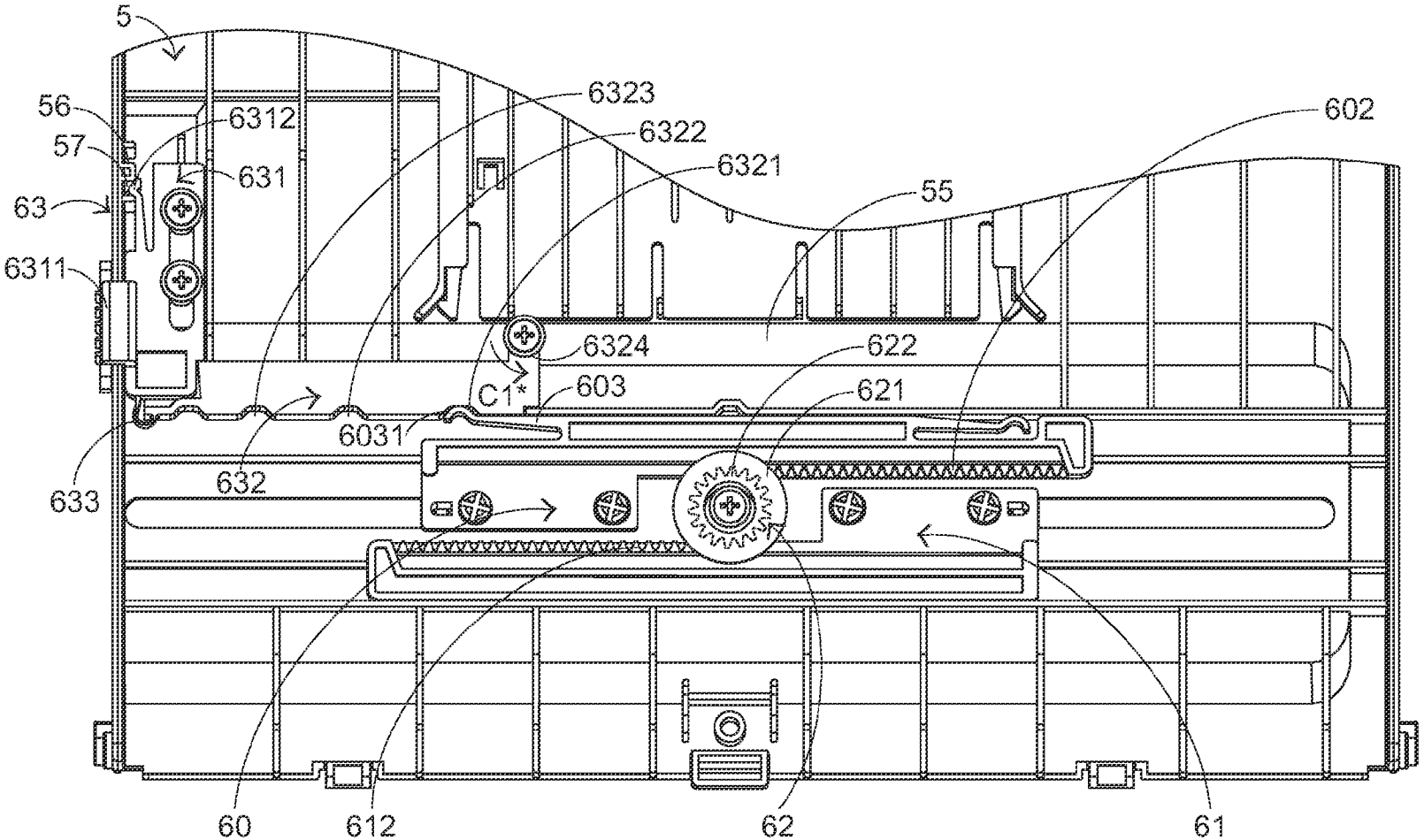
FIG. 8 is a schematic bottom view illustrating the document position-limiting mechanism according to the embodiment of the present invention, in which the document position-limiting mechanism is operated in a graduation positioning mode.

FIG. 8 is a schematic bottom view illustrating the document position-limiting mechanism according to the embodiment of the present invention, in which the document position-limiting mechanism is operated in a graduation positioning mode. For switching the operating mode of the document position-limiting mechanism 6 to the graduation positioning mode, the switching button 6311 of the driving part 631 should be moved in the first direction D1*, which is opposite to the second direction D2*. Consequently, the fixing bulge 6312 of the driving part 631 is disengaged from the first positioning notch 56 and then inserted into the second positioning notch 57. As the switching button 6311 is moved in the first direction D1*, the driving part 631 is correspondingly moved, and the post 6313 of the driving part 631 is sustained against the supporting structure 6325. Consequently, the positioning part 632 is swung in a first rotating direction C1* by using the pivotal structure 6324 as a fulcrum. In addition, the protrusion 6031 of the extension arm 603 is inserted into one of the recesses 6321, 6322 and 6323. Under this circumstance, the document position-limiting mechanism is operated in the graduation positioning mode.

When the user wants to scan an A6-sized document, the document position-limiting mechanism 6 should be firstly adjusted to comply with the A6-sized document. Then, the first paper guide plate 60 is moved toward the location of the first graduation 51 corresponding to the A6-sized document. Once the first paper guide plate 60 reaches the location of the first graduation 51, the protrusion 6031 of the extension arm 603 is inserted into the first recess 6321 corresponding to the first graduation 51. During the protrusion 6031 is inserted into the first recess 6321, a tactile feel is clearly sensed by the user. According to the tactile feel, the user may assure that the first paper guide plate 60 and the second paper guide plate 61 are located at the positions corresponding to the A6-sized document without the need of using the naked eyes to align the graduation. That is, the operations of the document position-limiting mechanism 6 in the graduation positioning mode are similar to those of the conventional document position-limiting mechanism 4.

From the above description, the document position-limiting mechanism of the present invention has a switching module. By means of the switching module, the operating mode of the document position-limiting mechanism can be switched. In a case that the document position-limiting mechanism is operated in the graduation positioning mode, the first paper guide plate may be aligned with the graduation without using the naked eyes. Whereas, in a case that the document position-limiting mechanism is operated in the manual positioning mode, the first paper guide plate and the second paper guide plate may be arbitrarily moved to any locations, so that various sizes of documents may be placed on the position-limiting mechanism. Moreover, since the switching module of the document position-limiting mechanism is produced by an injection molding technique, the driving part, the positioning part and the linking part of the switching module are integrally formed. Since the switching module is an integral component, the switching module can be easily assembled with other components of the document position-limiting mechanism. Consequently, according to the practical requirements of different users, the document position-limiting mechanism of the present invention can be applied to various sizes of documents or can be easily used to align the first paper guide plate without using the naked eyes.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A document position-limiting mechanism for use in a paper input tray of an automatic document feeder, said document position-limiting mechanism comprising:

a first paper guide plate disposed on said paper input tray for guiding a document to be fed into said automatic document feeder, wherein said first paper guide plate has an extension arm;

a second paper guide plate located at a first side of said first paper guide plate for guiding said document to be fed into said automatic document feeder, wherein said second paper guide plate is movable in a direction opposite to a moving direction of said first paper guide plate;

a connecting wheel arranged between said first paper guide plate and said second paper guide plate, and respectively engaged with said first paper guide plate and said second paper guide plate, so that said second paper guide plate is movable in said direction opposite to said moving direction of said first paper guide plate; and a switching module disposed on said paper input tray for switching an operating mode of said document position-limiting mechanism from a manual positioning mode to a graduation positioning mode or from said graduation positioning mode to said manual positioning mode, wherein said witching module comprises:

a driving part comprising a switching button, which is exposed to said paper input tray, wherein said switching module is moved by operating said switching button; and a positioning part comprising a plurality of recesses and a pivotal structure, wherein said pivotal structure is located at a second end of said positioning part and connected to said paper input tray, wherein as said switching button is moved, said positioning part is swung in response to movement of said driving part, wherein when said extension arm is inserted into one of said plurality of recesses, said document position-limiting mechanism is operated in said graduation positioning mode, wherein when said extension arm is disengaged from said plurality of recesses, said document position-limiting mechanism is operated in said manual positioning mode.

2. The document position-limiting mechanism according to claim 1 wherein said switching module further comprises a linking part, which is arranged between said driving part and said positioning part for connecting said driving part and said positioning part, wherein said driving part, said positioning part and said linking part are integrally formed.

3. The document position-limiting mechanism according to claim 1 wherein said positioning part further comprises a supporting structure, which is located at a first end of said positioning part, wherein said driving part further comprises a post, which is located at a first end of said driving part, wherein when said post is embedded into said supporting structure, said first end of said positioning part is in contact with said first end of said driving part.

4. The document position-limiting mechanism according to claim 3 wherein when said switching button is moved in a first direction, said driving part is correspondingly moved and said post is sustained against said supporting structure, so that said positioning part is swung in a first rotating direction with said pivotal structure serving as a fulcrum and said extension arm is inserted into one of said plurality of recesses, wherein when said switching button is moved in a second direction opposite to said first direction, said driving part is correspondingly moved and said post is separated from said supporting structure, so that said positioning part is swung in a second rotating direction with said pivotal structure serving as said fulcrum and said extension arm is disengaged from said plurality of recesses.

5. The document position-limiting mechanism according to claim 1 wherein said pivotal structure is connected to said paper input tray by a screwing means, so that said pivotal structure is rotatable relative to said paper input tray, wherein said pivotal structure is integrally formed with said positioning part.

6. The document position-limiting mechanism according to claim 1 wherein said extension arm further comprises a protrusion, which is located at an end of said extension arm, wherein when said document position-limiting mechanism is operated in said graduation positioning mode, said protrusion is inserted into one of said recesses.

7. The document position-limiting mechanism according to claim 6 wherein said first paper guide plate further comprises a first paper stopper and a first rack, and said second paper guide plate further comprises a second paper stopper and a second rack, wherein said first paper stopper is exposed to an outer surface of said paper input tray for stopping a first edge of said document, said first rack is connected with said first paper stopper and engaged with said connecting wheel, said second paper stopper is exposed to said outer surface of said paper input tray for stopping a second edge of said document, and said second rack is connected with said second paper stopper and engaged with said connecting wheel.

8. The document position-limiting mechanism according to claim 7 wherein said connecting wheel further comprises:

a wheel body disposed on said inner surface of said paper input tray; and a plurality of toothed structures disposed on said wheel body and engaged with said first rack and said second rack, so that the wheel body is rotatable relative to said first rack and said second rack.

9. The document position-limiting mechanism according to claim 1 wherein said driving part further comprises a fixing bulge, and said paper input tray further comprises a first positioning notch and a second positioning notch, wherein said fixing bulge is disposed on an inner surface of said paper input tray, said first positioning notch is located at a first side of said inner surface of said paper input tray, and said second positioning notch is located at said first side of said inner surface of said paper input tray and adjacent to said first positioning notch, wherein when said document position-limiting mechanism is operated in said manual positioning mode, said fixing bulge is inserted into said first positioning notch, wherein when said document position-limiting mechanism is operated in said graduation positioning mode, said fixing bulge is inserted into said second positioning notch.

10. The document position-limiting mechanism according to claim 9 wherein said fixing bulge and said switching button are integrally formed with said driving part.

* * * * *